US007645084B1

(12) United States Patent
Schulte

(10) Patent No.: US 7,645,084 B1
(45) Date of Patent: Jan. 12, 2010

(54) BATH MESH SQUIRT TOY

(75) Inventor: Kathleen K. Schulte, Woonsocket, RI (US)

(73) Assignee: JKA, Inc., Woonsocket, RI (US)

( * ) Notice: Subject to any disclaimer, the term of this patent is extended or adjusted under 35 U.S.C. 154(b) by 0 days.

(21) Appl. No.: 12/215,059

(22) Filed: Jun. 26, 2008

(51) Int. Cl.
*B43M 11/06* (2006.01)

(52) U.S. Cl. ..... 401/185; 401/183; 401/205

(58) Field of Classification Search ..... 401/183–186, 401/196–207
See application file for complete search history.

(56) References Cited

U.S. PATENT DOCUMENTS 5,944,032 A * 8/1999 Masterson ..... 132/290
5,983,435 A * 11/1999 Osborne ..... 15/209.1
6,296,540 B1 * 10/2001 LaPlaca et al. ..... 446/75
D532,554 S * 11/2006 Zall ..... D28/63
7,182,540 B2 * 2/2007 Sorrell ..... 401/205

* cited by examiner

*Primary Examiner*—David J Walczak
(74) *Attorney, Agent, or Firm*—John Brooks Law LLC; John J Brooks, III

(57) ABSTRACT

A fabric mesh ball attached to a toy member in the shape of an animal such as a duck, fish or frog so as the toy member serves as a grasping handle for the mesh ball and furthermore serves as a squirt toy in that a hollow body portion of the toy member includes a squirt opening preferably positioned near the mouth of the particular animal.

14 Claims, 9 Drawing Sheets

BATH MESH SQUIRT TOY

BACKGROUND OF THE INVENTION

This invention relates to devices commonly referred to as a bath mesh or bath ball. Such devices are used for bathing purposes especially for lightly rubbing the skin and are particularly popular for bathing babies, toddlers and the like in adult or smaller child-sized bath tubs. An example of such a device is shown in U.S. Pat. Nos. 7,013,523 and 6,443,527 to Chang and Borcherds et al in which strips of plastic mesh are would around spaced posts, secured in the center with a tie cord and then released to form a roughly spherically shaped ball.

Children enjoy splashing in the tub and generally assisting in the bathing process, and thus it has been proposed to combine animal and other Children enjoy splashing in the tub and generally assisting in the bathing process, and thus it has been proposed to combine animal and other shaped objects with such bath balls. Fastening such animal shapes in a secure manner to the bath balls such that the animal-shaped portion can be utilized as a handle for manipulating the combined bath ball has not been proposed and such is a positive objective of the present invention.

Children also enjoy squirting toys to squirt, shoot or spray bath water at each other and their parents or other caregiver, and such toys are widely available as well. Such toys are often hollow objects, e.g., animal shapes, that can be squeezed to fill with bath water and then squirt water therefrom. These toys use a common opening to load (fill) and squirt the water. These toys, however, overlook the fact that bath water often includes dirt, soap scum and, heaven's forbid, fecal matter and the like and do not provide and/or incorporate a means to filter such objectionable materials from the bath water prior to entering the hollow animal body. Accordingly, an object of the present invention is to combine a hollow animal-shaped body with a bath scrub ball such that the ball's mesh fabric serves as a filter for such objectionable materials.

These and other objects of the present invention are accomplished by fastening a hollow object, e.g., an animal shape, to a bath mesh ball in such a position that the water intake opening to the object's hollow interior cavity is positioned entirely within the mesh such that at least the larger solid contaminants are filtered and prevented from entering the object's interior cavity during the loading or filling cycle of the bath water such that less contaminated water is squirted generally from a separate exit opening in the object's body.

A still further objective of the present invention is to provide a combination bath scrub ball and water toy comprising a mesh scrub bail with a toy member attached thereto to form a handle by which the bath ball may be grasped and manipulated by the user, said mesh ball formed of multiple folds of mesh fabric fastened in position via a tie cord surrounding and cinching said folds to maintain said ball shape, said toy member having a hollow flexible wall body including a bottom wall in turn having a fill opening therethrough and attachment means for firmly attaching said toy member to said bath ball with said bottom wall nestled among the folds of said bath ball such that when the hollow body is at least partially submerged in water and then air is forced out of said attachment opening by inwardly compressing said body so that water is dawn upwardly into said body through said fill opening as well as portions of said bath mesh fabric to, in effect, filter the water entering the body when the compressive action in the body is released, said hollow body having a second squirt opening extending through the body wall at a level above said fill opening such that at least a portion of the water within the body is forced out of said squirt opening when the body is again inwardly compressed.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
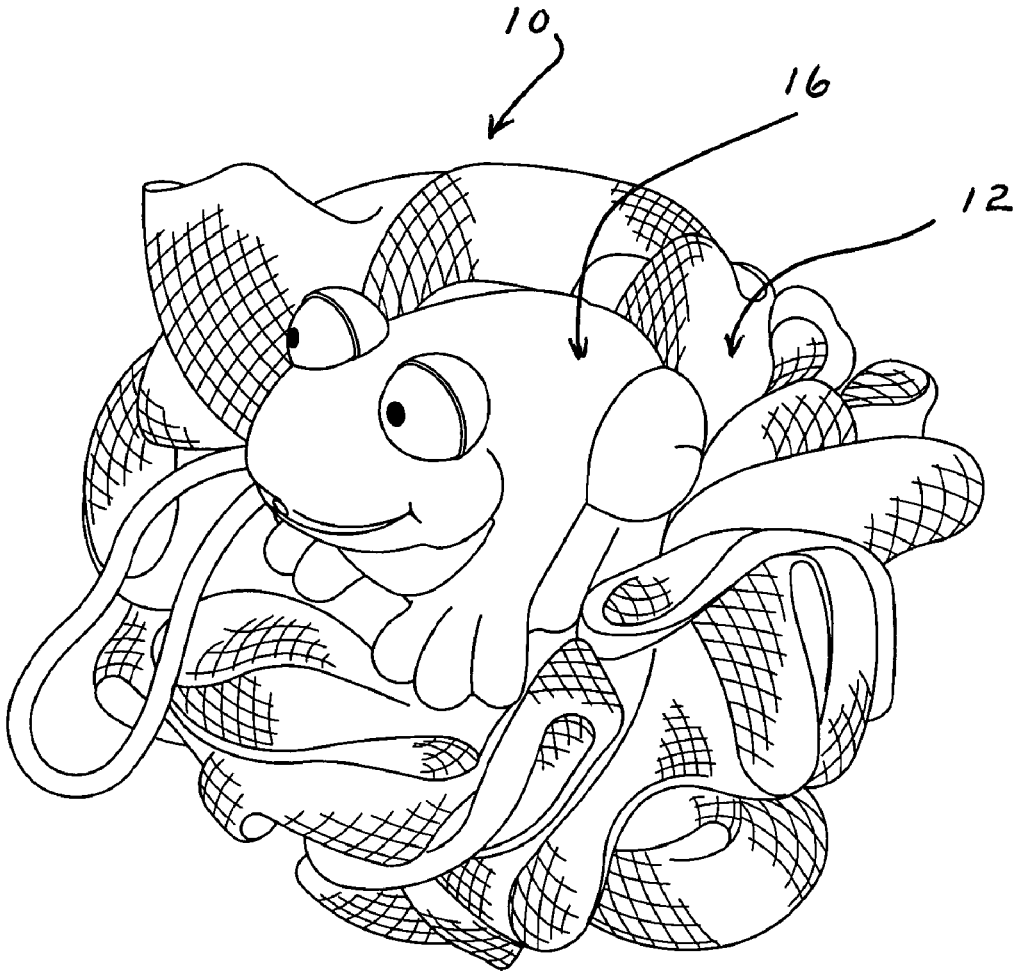
FIG. 1 is a top perspective view of a combination bath ball with an attached animal body serving as a combination handle and squirt toy.
Figure 2:
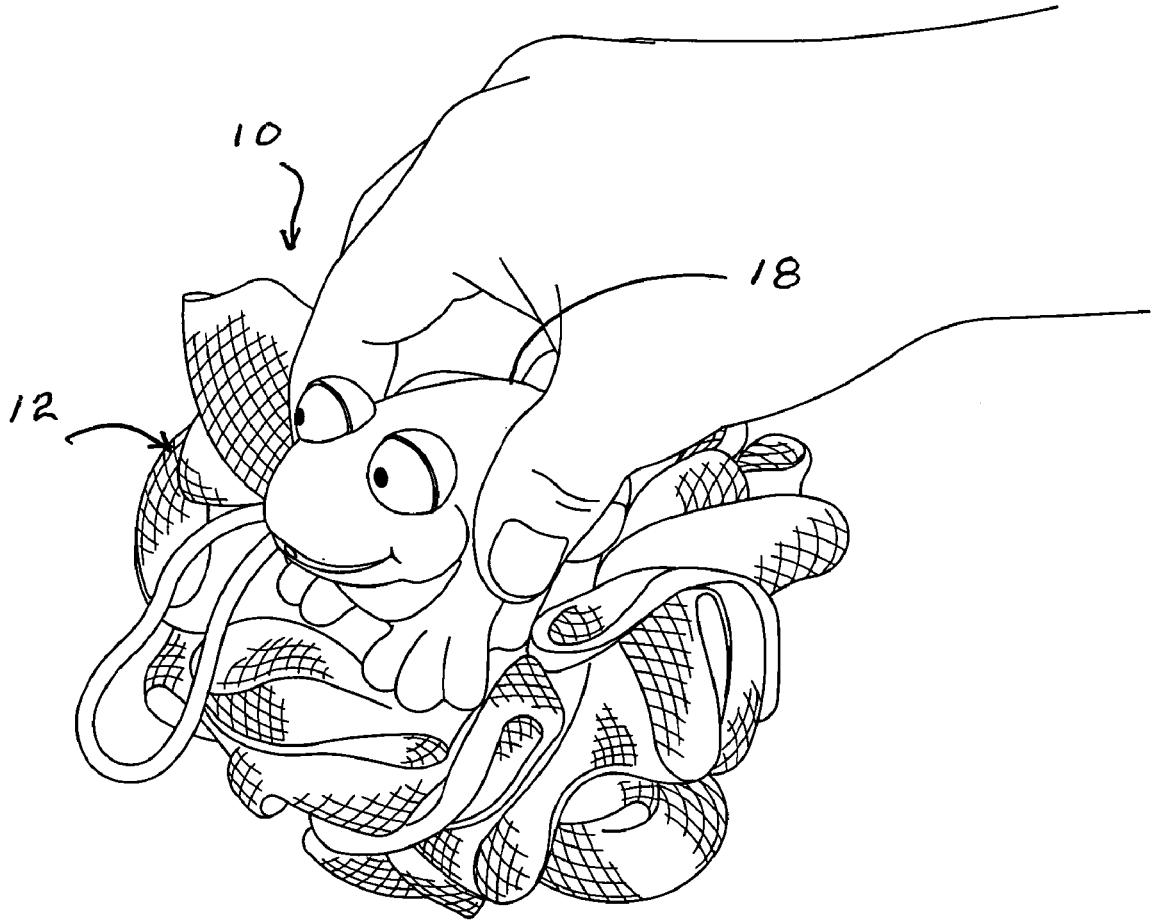
FIG. 2 is a top perspective view similar to FIG. 1 but illustrating how the user may grasp the device of the present invention.
Figure 3:
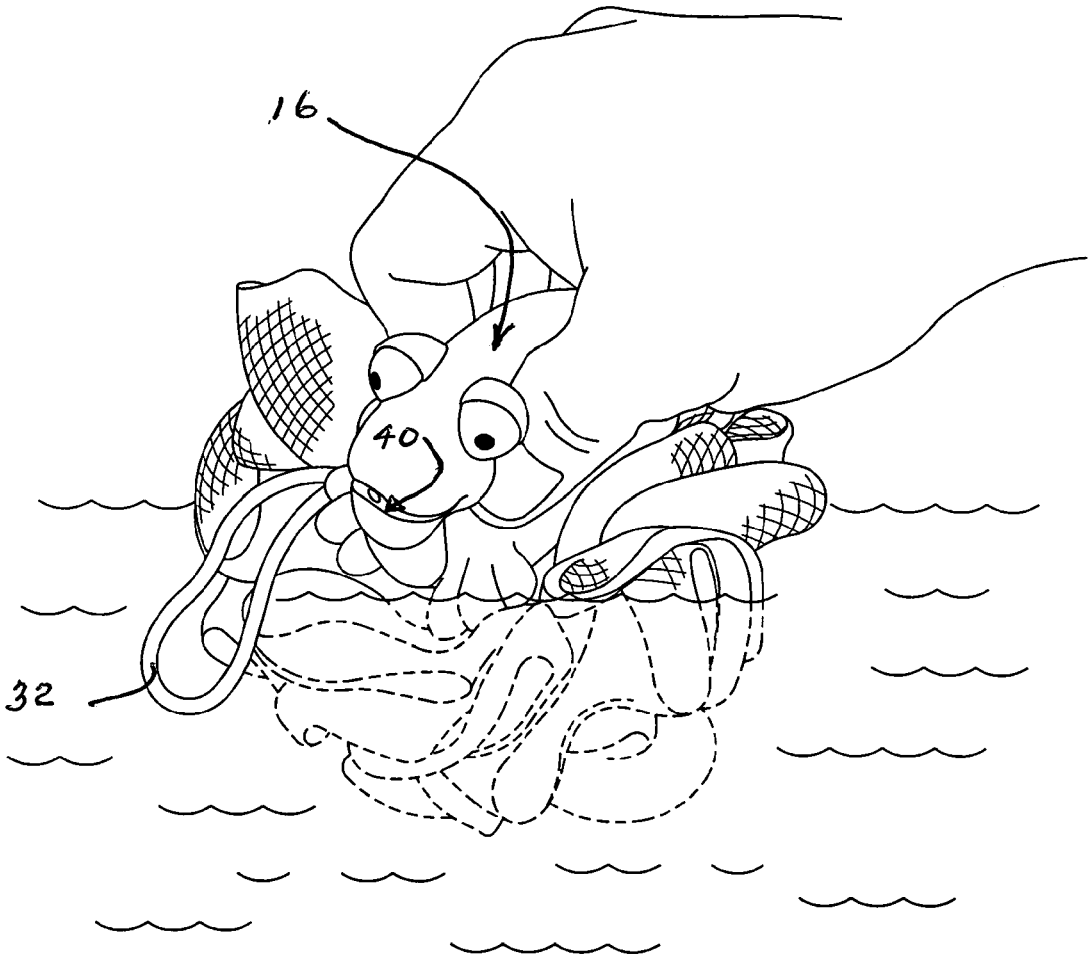
FIG. 3 is a top perspective view similar to FIG. 2 but showing how the animal body is squeezed to force air out of the body and then partially submerged to fill the body with water.

The overall configuration of the combination bath ball and water toy 10 if the present invention is depicted in the drawings and particularly in FIG. 1 thereof. Therein a conventional bath ball 12 formed of mesh plastic fabric material cinched in the center with a tie cord 14 (see FIG. 4A). The toy member 16 is shown as a frog but could take any shape although preferably an animal shape and includes a hollow body 18 having sidewalls 20 and a bottom wall 22. The toy member 16 is attached to the ball 12 such that the bottom wall 22 is nestled among the fabric folds of the mesh ball. The manner of attachment can vary from stapling or adhesive connection (not shown) to the preferred cord attachment method shown in the drawings.

The bottom wall 22 is provided with a combination attachment and fill opening 24 whereby an attachment cord 26 having a knotted first end 28 that is forced into the interior of the body 18 via the attachment opening 24 and a second end 30 that is firmly tied around the tie cord 14 and preferably terminating in a looped cord portion 32 which extends outwardly from the mesh ball and serves as a means to suspend such for drying and storage. The diameter of the opening 24 is greater than the cord 26 but smaller than the knotted first end 28 such that when the cord 26 is tightened about the tie cord 14 the cord 26 draws the body 18 of the toy member 16 into the interior of the mesh fabric and serves to additionally firmly attach the body 18 to the ball 12. This attachment means serves to enable the body to act as a handle or grasping area by which the combination device 10 may be held and manipulated by the user in the bathing, etc., process. An additional feature of this attachment manner is that this attachment manner provides a fill opening for water to enter the body's hollow interior of the toy member 16 as will hereinafter be more evident.

Figure 4:
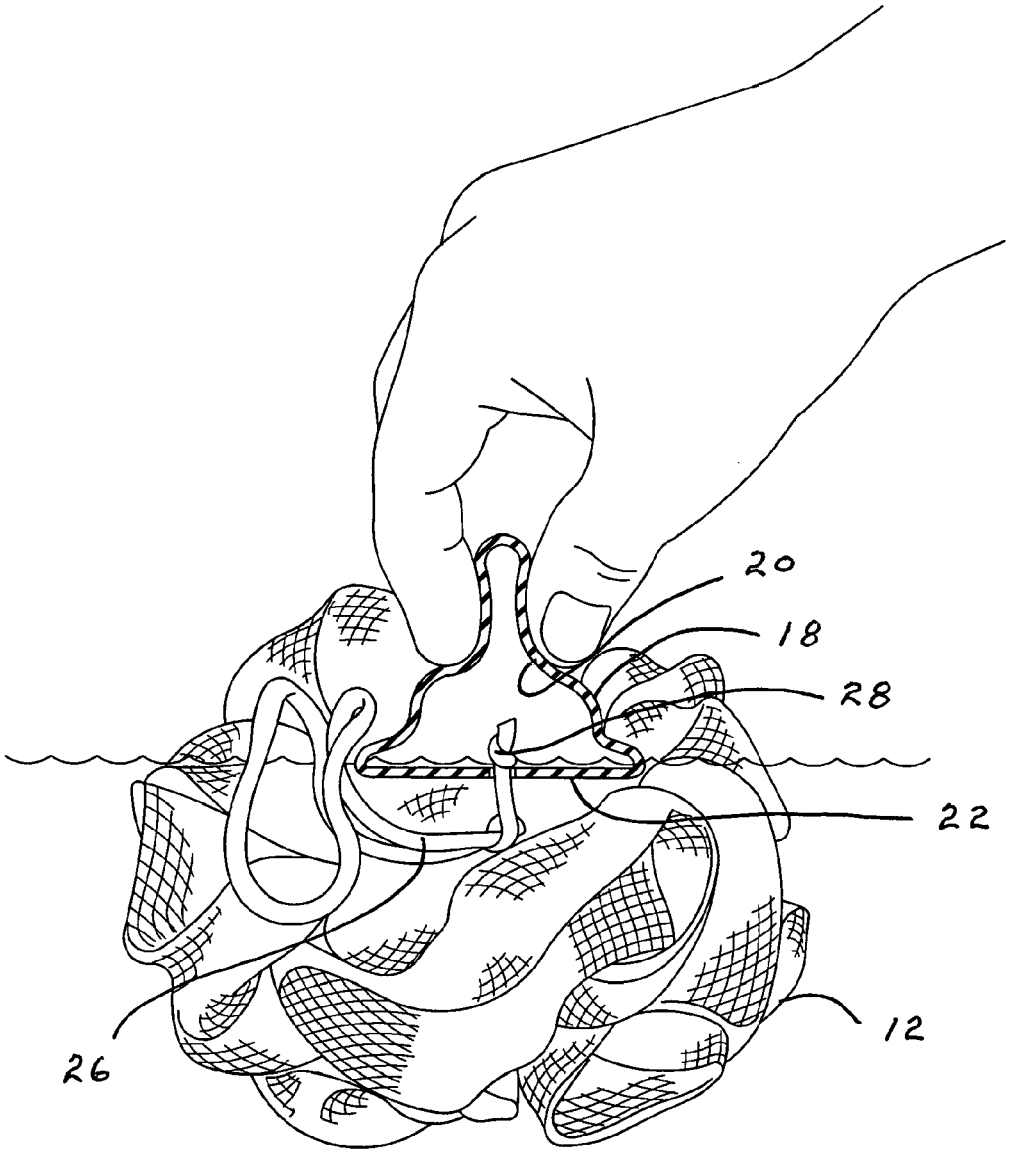
FIG. 4 is partial side sectional view of FIG. 3 illustrating the squeezing action upon the animal body.
Figure 4A:
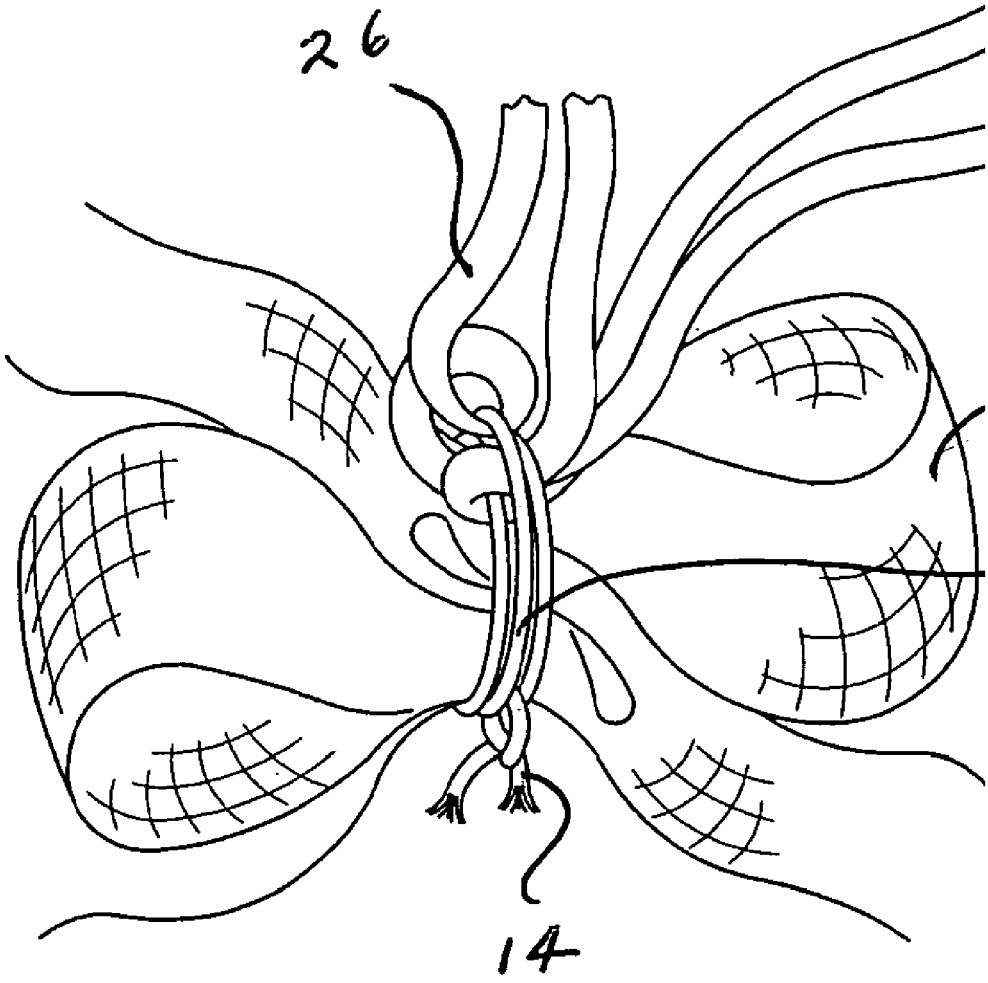
FIG. 4A is an enlarged partial sectional view of a portion of FIG. 4 to better show the preferred manner of attaching the body to the tie cord of the mesh ball via a separate attachment cord.
Figure 5:
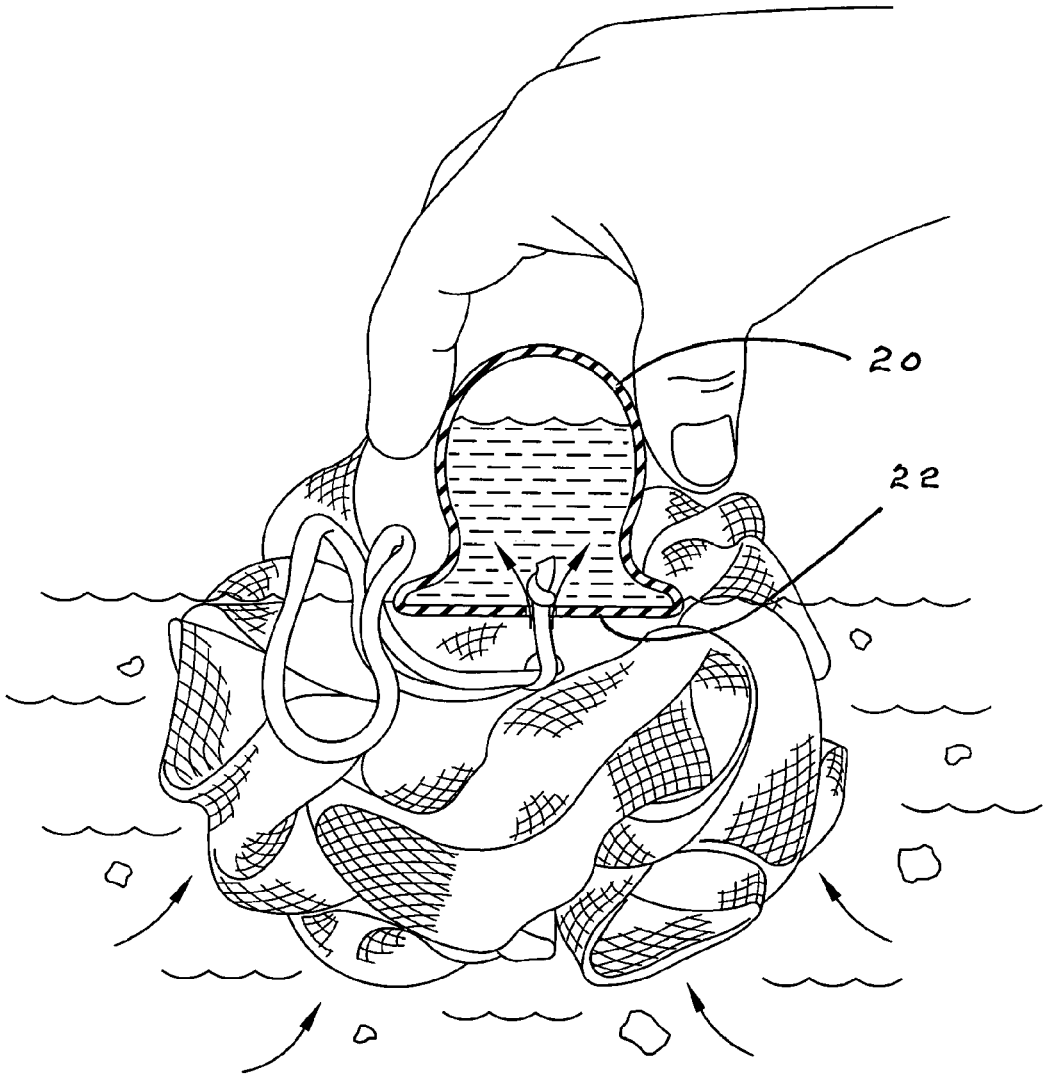
FIG. 5 is a partial side sectional view of FIG. 3 illustrating how water is drawn through the bottom of the body to fill the same with water.
Figure 6:
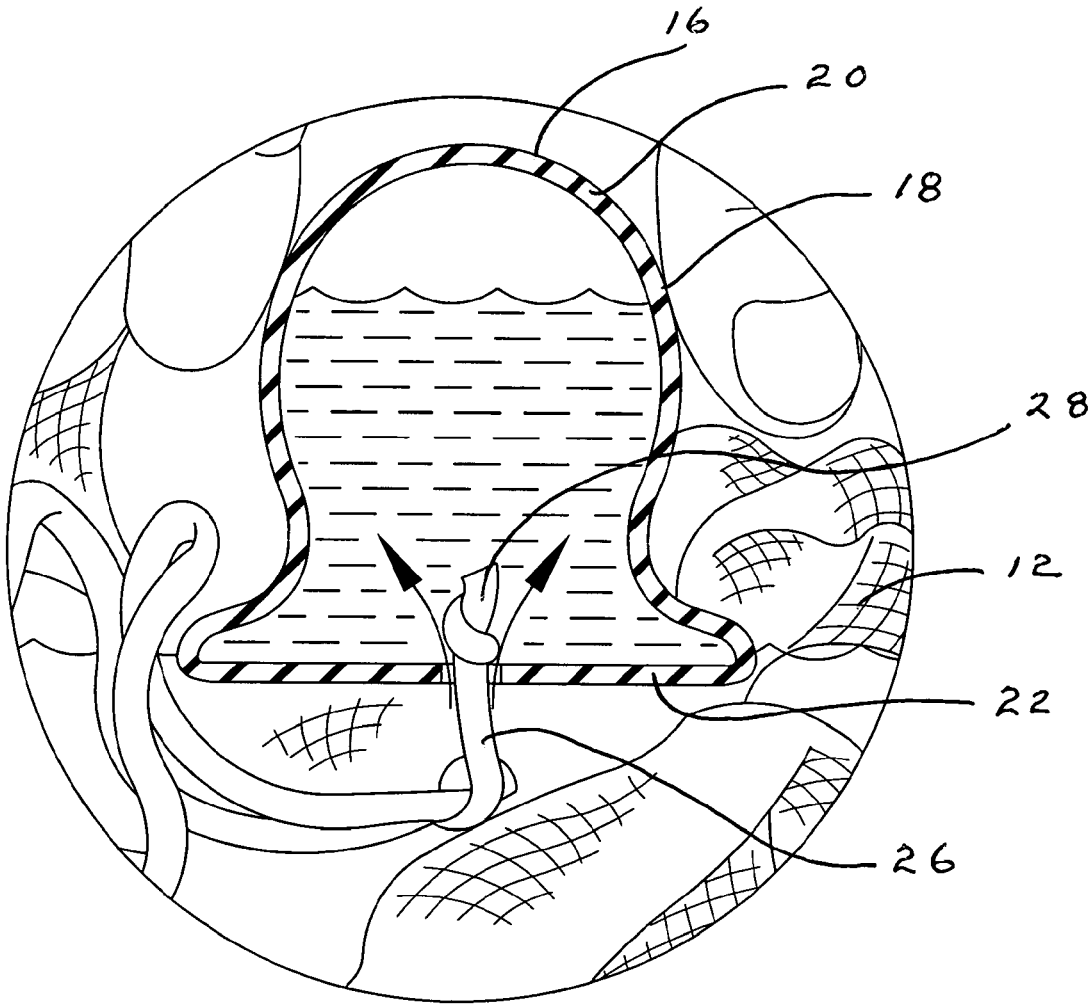
FIG. 6 is an enlarged partial view of FIG. 5.

This feature of the present invention of enabling the toy member 16 to function as a squirt toy wherein the water entering the hollow body 18 is additionally filtered by the mesh fabric of the bath ball 12 is illustrated in the sequence of filling and squirting in FIGS. 4-8. As shown in FIG. 4, the body 18 is squeezed or compressed to reduce the air volume contained therein and then placed in the bath water in a position where the fill opening 24 of the bottom wall is submerged underwater. The body is then released so as to draw water through the mesh fabric upwardly into the body's interior cavity via the attachment/fill opening 24. As previously indicated, the diameter or other extent of the opening, if not circular, is larger than that of the attachment cord 26 such that there is ample room, to accommodate the water's upward flow into the body 18 and as is best shown by the arrows in FIG. 6.

Figure 7:
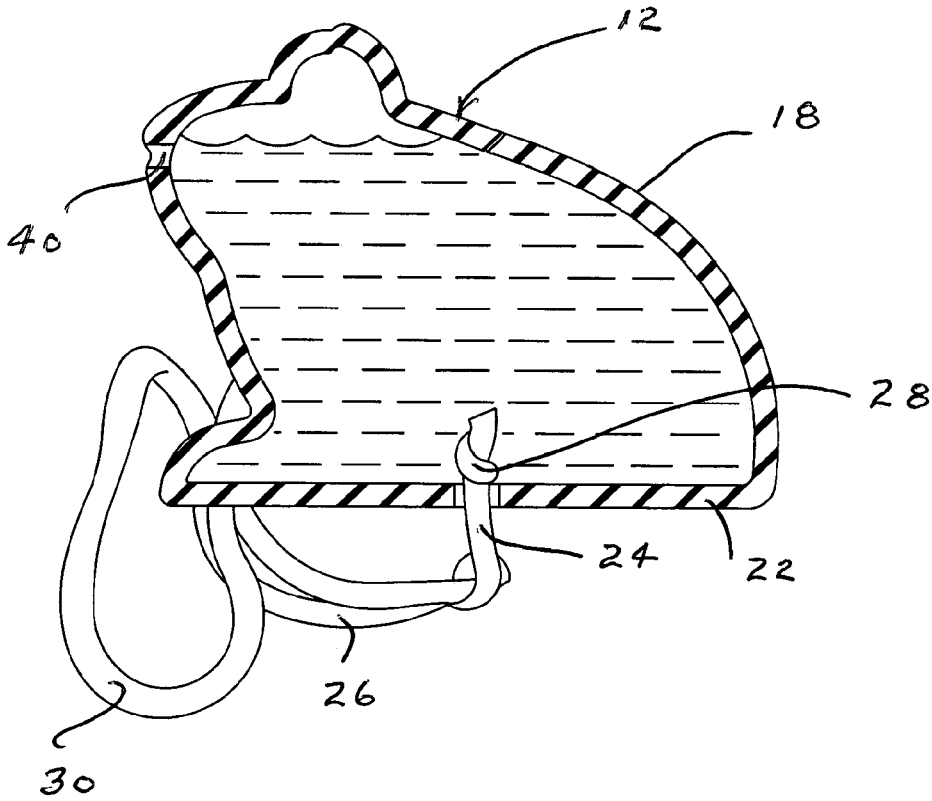
FIG. 7 is a side sectional view of the animal body filled with water with the bath ball removed for clarity.

In addition and as best shown by FIG. 7, a squirt or exit opening 40 is provided in the body 18 at a level above the bottom wall and preferably positioned to replicate a body part of the animal represented by the member 16, i.e., the animal's mouth, trunk, beak, etc., although special effects could be created by having the squirt opening or openings coincide with an animal's eyes, ears, etc. Obviously, the member 16 does not have to be of an animal shape but such feature adds additional interest to young children.

Figure 8:
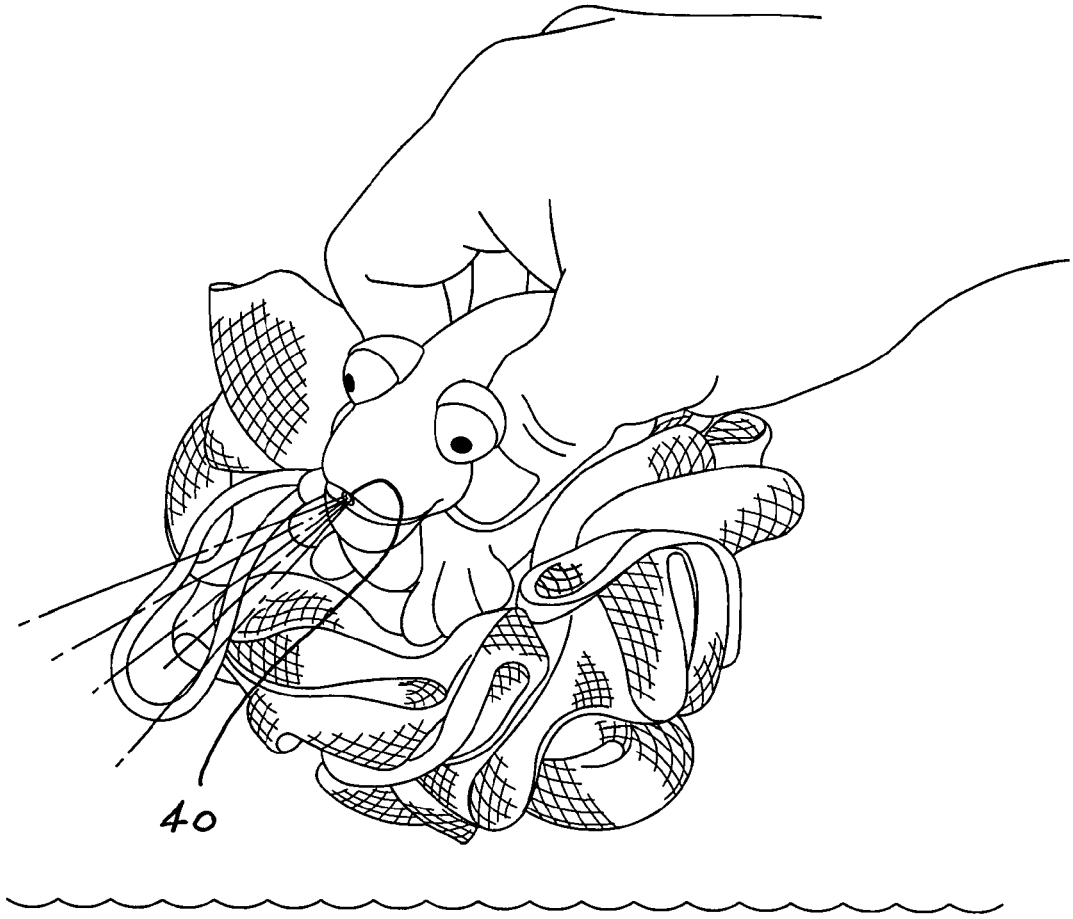
FIG. 8 is a top perspective view similar to FIGS. 1-3 showing the water-filled body being squeezed by the user to force water out of the squirt opening thereof.

Once the toy member 16 has been filled and or partially filled with water, the body may then be squeezed to force water out of the squirt opening 40 as best shown in FIG. 8. It should be pointed out that some water may also be simultaneously forced out of the fill opening 24 but since that opening is, in effect, shielded by the opening's positioning within the mesh ball, leakage and unintended directional squirting from the fill opening is minimized. The squirt opening's side is preferably smaller than that of the fill opening to enable a longer water stream being forced there out by the above-indicated manipulation. Also, the user assuming the necessary coordination may hold his/her finger against the fill opening while squeezing the body so as to direct most all the water out of the squirt opening.

The disclosure of the prior art patents listed in the Background section are hereby incorporated into the present specification by specific reference thereto; however, it should be pointed out that the processes set forth in those patents do not necessarily have to be utilized to form the mesh balls of the present invention. Such mesh balls are also commonly referred to as bath balls and poufs.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A combination bath scrub ball and water toy comprising a mesh scrub ball with a toy member attached thereto by attachment means, said mesh ball formed of multiple folds of mesh fabric fastened in position via a tie cord surrounding and cinching said fabric folds to maintain said ball shape, said toy member having a hollow flexible wall body and including a bottom wall in turn having an attachment opening therethrough, said attachment means including an attachment cord of a diameter less than that of said attachment opening and having an enlarged first end larger than said attachment opening and extending through said bottom wall attachment opening and a second end in turn attached to said tie cord so as to fasten said toy member to said bath ball, said bottom wall being nestled among the folds of said bath ball such that when the hollow body is at least partially submerged in water and then air is forced out of said attachment opening by inwardly compressing said body so that water is drawn upwardly into said body through said attachment opening as well as portions of said bath mesh fabric to filter the water entering the body when the compressive action in the body is released, said hollow body having a second squirt opening extending through the body wall at a level above said attachment opening such that at least a portion of the water within the body is forced out of said squirt opening when the body is again inwardly compressed.

2. The combination bath scrub ball and water toy of claim 1, wherein said squirt opening is of a lesser diameter than that of said attachment opening.

3. The combination bath scrub ball and water toy of claim 1, wherein said toy member body is shaped in the form of an animal.

4. The combination bath scrub ball and water toy of claim 3, wherein said squirt opening is positioned proximal a mouth of the animal represented by the body and the bottom wall positioned proximal a foot portion of the animal.

5. The combination bath scrub ball and water toy of claim 4, wherein said animal shape is that of a frog.

6. The combination bath scrub ball and water toy of claim 1, wherein said attachment cord and said tie cord are portions of the same cord.

7. The combination bath scrub ball and water toy of claim 1, wherein the enlarged first end of said attachment cord is a knot.

8. The combination bath scrub ball and water toy of claim 1, wherein said toy member forms a handle whereby grasping the toy body by the user enables the user to manipulate the scrub ball for bathing.

9. The combination bath scrub ball and water toy of claim 8, wherein the second end of said attachment cord includes a separate looped terminal portion extending outwardly from said mesh ball and forming a hanging means therefore.

10. The combination bath scrub ball and water toy of claim 1, where the attachment cord and tie cord are separate cords.

11. A combination bath scrub ball and water toy comprising a mesh scrub ball with a toy member attached thereto to form a handle by which the bath ball may be grasped and manipulated by the user, said mesh ball formed of multiple folds of mesh fabric fastened in position via a tie cord surrounding and cinching said folds to maintain said ball shape, said toy member having a hollow flexible wall body including a bottom wall in turn having a fill opening therethrough and attachment means for firmly attaching said toy member to said bath ball with said bottom wall nestled among the folds of said bath ball such that when the hollow body is at least partially submerged in water and then air is forced out of said attachment opening by inwardly compressing said body so that water is dawn upwardly into said body through said fill opening as well as portions of said bath mesh fabric to filter the water entering the body when the compressive action in the body is released, said hollow body having a second squirt opening extending through the body wall at a level above said fill opening such that at least a portion of the water within the body is forced out of said squirt opening when the body is again inwardly compressed.

12. The combination bath scrub ball and water toy of claim 11, wherein said toy member body is shaped in the form of an animal.

13. The combination bath scrub ball and water toy of claim 12, wherein said squirt opening is positioned proximal a mouth of the animal represented by the body and the bottom wall positioned proximal a foot portion of the animal.

14. The combination bath scrub ball and water toy of claim 11, wherein said toy member forms a handle whereby grasping the toy body by the user enables the user to manipulate the scrub ball for bathing.

* * * * *